US009230433B2

(12) United States Patent
Lee et al.

(10) Patent No.: US 9,230,433 B2
(45) Date of Patent: Jan. 5, 2016

(54) METHOD AND APPARATUS FOR AUTHENTICATING GROUP DRIVING OF MOVING OBJECT

(71) Applicant: Electronics and Telecommunications Research Institute, Daejeon (KR)

(72) Inventors: Sang-Woo Lee, Daejeon (KR); Byung-Gil Lee, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 307 days.

(21) Appl. No.: 13/675,502

(22) Filed: Nov. 13, 2012

(65) Prior Publication Data

US 2014/0074387 A1 Mar. 13, 2014

(30) Foreign Application Priority Data

Sep. 13, 2012 (KR) ..... 10-2012-0101483

(51) Int. Cl.
*G08G 1/00* (2006.01)
*G08G 1/01* (2006.01)

(52) U.S. Cl.
CPC ..... *G08G 1/0125* (2013.01); *G08G 1/20* (2013.01); *G08G 1/22* (2013.01)

(58) Field of Classification Search
CPC ..... G08G 1/0125; G08G 1/07; G08G 1/20; G08G 1/02; G08G 1/22
USPC ..... 701/117, 29.3
See application file for complete search history.

(56) References Cited

U.S. PATENT DOCUMENTS

| | | | | |
|---|---|---|---|---|
| 7,036,146 | B1 * | 4/2006 | Goldsmith | 726/21 |
| 2010/0100619 | A1 | 4/2010 | Chang et al. | |
| 2011/0167059 | A1 * | 7/2011 | Fallah | 707/723 |

FOREIGN PATENT DOCUMENTS

| | | | |
|---|---|---|---|
| JP | 10-261195 | | 9/1998 |
| JP | 2002-8077 | | 1/2002 |
| JP | 2011-227728 | | 11/2011 |
| KR | 1020060105693 | | 10/2006 |
| KR | 1020080050919 | | 6/2008 |
| KR | 10-0957137 | | 5/2010 |
| KR | 1020120055832 | | 6/2012 |
| WO | 2010/098554 | A2 | 9/2010 |
| WO | WO 2010098554 | A2 * | 9/2010 |

* cited by examiner

*Primary Examiner* — Nga X Nguyen
(74) *Attorney, Agent, or Firm* — Nelson Mullins Riley & Scarborough LLP

(57) ABSTRACT

A method authenticates a group driving service of a moving object. The method includes authenticating the moving object when an authentication request for the registration of the group driving service is received from the moving object, generating a certain group having group driving service registration information based on group driving registration information when a registration request for the group driving service is received from the moving object, the registration request including the group driving registration information, and transmitting the group driving service registration information of the certain group to the moving object.

15 Claims, 4 Drawing Sheets

| ITEM(S) | USER INPUT UNIT |
|---|---|
| GROUP DRIVING QUALIFICATION | LEADER OR MEMBER SELECTION |
| STARTING PLACE | USER INPUT |
| DESTINATION | USER INPUT |
| ESTIMATED TIME OF DEPARTURE | USER INPUT |
| ESTIMATED TIME OF ARRIVAL | USER INPUT |
| DESIRED RESTING PLACE | NONE OR PLACE NAME |

*FIG. 6*

| |
|---|
| FALSE NAME |
| FALSE NAME CERTIFICATE |
| EXPIRATION DATE |
| GROUP ID |
| MOVING OBJECT NAVIGATION DATA |
| MOVING OBJECT NAVIGATION DATA SIGNATURE |

METHOD AND APPARATUS FOR AUTHENTICATING GROUP DRIVING OF MOVING OBJECT

RELATED APPLICATIONS(S)

This application claims the benefit of Korean Patent Application No. 10-2012-0101483, filed on Sep. 13, 2012, which is hereby incorporated by references as if fully set forth herein.

FIELD OF THE INVENTION

The present invention relates to a scheme of authenticating a group driving service of a moving object, and more particularly, to a method and apparatus for authenticating a group driving service of a moving object, which is suitable for registering a group driving service through identifier (ID) authentication of a moving object such as a vehicle, generating group driving service registration information necessary for the group driving of the moving object, and providing the group driving service registration information to the moving object for the group driving.

BACKGROUND OF THE INVENTION

As it is well-known, as a high-tech traffic technology such as an electronic control and communications and traffic information are developed and applied to traffic facilities, a vehicular transportation system is evolving into an information transportation system (ITS) that represents a traffic system whose operation and management become automatic and scientific and which improves the efficiency and safety of the transportation.

In particular, through the use of a vehicle communications technology such as inter vehicle communications and communications between a vehicle and a roadside device, the vehicular transportation system is evolving for enhancing the driving safety and providing a driver with a convenient service, thereby achieving effects of reducing a traffic accident and enhancing the traffic efficiency. A notable example thereof is the group driving of vehicles using the ITS.

This conventional group driving is managed by grouping a plurality of unspecified vehicles that is moving in the same direction, allowing the vehicles to exchange information therebetween, and implementing the group driving of the vehicles based on the exchanged information.

Since, however, the conventional group driving method is performed on unspecified vehicles, it is difficult to secure reliability between vehicles participating in the group driving by the absence of authentication for the vehicles. In addition, there is a problem of exposing privacy of the vehicles participating in the group driving.

SUMMARY OF THE INVENTION

Various embodiments of the invention are directed to providing a method and apparatus for authenticating a group driving service of a moving object, which is suitable for registering a group driving service through identifier (ID) authentication of a moving object such as a vehicle, generating group driving service registration information necessary for the group driving of the moving object, and providing the group driving service registration information to the moving object for the group driving.

In accordance with an aspect of the present invention, there is provided a method for authenticating a group driving service of a moving object, the method including authenticating the moving object when an authentication request for the registration of the group driving service is received from the moving object, generating a certain group having group driving service registration information based on group driving registration information when a registration request for the group driving service is received from the moving object, the registration request including the group driving registration information, and transmitting the group driving service registration information of the certain group to the moving object.

The authenticating of the moving object may include receiving the authentication request from the moving object, verifying an ID of the moving object, and generating an authentication response based on a result of verifying the ID and transmitting the authentication response to the moving object.

Herein the authenticating of the moving object may be performed using a digital signature algorithm of a public key crypto system, and the group driving registration information may include one of group driving qualification, a starting place, a destination, an estimated time of departure, an estimated time of arrival, a desired resting place, and a combination thereof.

The method may further include generating a false name of each moving object in the certain group before transmitting the group driving service registration information to the moving object, requesting an authentication center the generation of a false name certificate for the false name, and receiving the false name certificate from the authentication center, wherein the group driving service registration information may include a group ID of the certain group and the false name for each moving object in the certain group.

The method may further include performing communications between moving objects in the certain group using the group driving service registration information, and a communication message for the communications between the moving objects may include one of a false name, a false name certificate, an expiration date, a group ID, moving object navigation data, a moving object navigation data signature, and a combination thereof, wherein expiration date may be an expiration date of the false name, wherein the moving object navigation data may include speed information and location information of each moving object in the certain group, and wherein the communication message may further include driver input information provided by a driver of each moving object in the certain group.

In accordance with another aspect of the present invention, there is provided an apparatus for authenticating a group driving service of a moving object, the apparatus including a moving object ID verification block configured to authenticate an identifier (ID) of the moving object when an authentication request for the registration of the group driving service is received from the moving object, a group generating and registering block configured to generate a certain group having group driving service registration information based on group driving registration information when a registration request for the group driving service is received from the moving object, the registration request including the group driving registration information, a false name generating block configured to secure a false name certificate including a false name assigned to each moving object in the certain group, and an interface block configured to transmit the group driving service registration information including the false name certificate to the moving object.

The false name generating block is configured to generate a false name of each moving object in the certain group, request an authentication center the generation of a false name certificate for the generated false name through the interface block, and secure the false name certificate from the authentication center.

The apparatus may further include a group information database (DB) configured to store the group driving registration information and the group driving service registration information.

In accordance with embodiments of the present invention, it is possible to secure reliability between moving objects participating in the group driving and to prevent the privacy of a moving object participating in the group driving from being exposed by authenticating the moving object when an authentication request for the registration of a group driving service is received from the moving object, generating a certain group having group driving service registration information based on group driving registration information when a registration request for the group driving service including the group driving registration information is received from the moving objects, and transmitting the group driving service registration information of the certain group to the moving object.

BRIEF DESCRIPTION OF THE DRAWINGS

The above and other objects and features of the present invention will become apparent from the following description of embodiments given in conjunction with the accompanying drawings, in which:

FIG. 6 illustrates a communication message for the communications between moving objects in a group in accordance with an embodiment of the present invention.

DETAILED DESCRIPTION OF THE EMBODIMENTS

Embodiments of the present invention will be described in detail. However, the present invention is not limited to the embodiments disclosed below, but can be implemented in various forms. Therefore, the following embodiments are described in order for this disclosure to be complete and enabling to those of ordinary skill in the art.

In addition, in the following description of the present invention, if the detailed description of the already known structure and operation may confuse the subject matter of the present invention, the detailed description thereof will be omitted. The following terms are terminologies defined by considering functions in the embodiments of the present invention and may be changed operators intend for the invention and practice. Hence, the terms should be defined throughout the description of the present invention.

Hereinafter, embodiments of the present invention will be described in detail with reference to the accompanying drawings.

Figure 1:
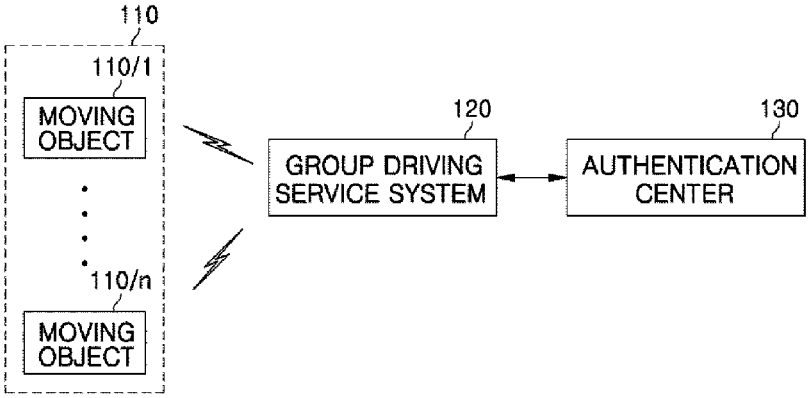
FIG. 1 is a schematic diagram of a group driving service authentication system to which a group driving service authentication device is applied in accordance with an embodiment of the present invention.

FIG. 1 is a schematic diagram of a group driving service authentication system to which a group driving service authentication device is applied in accordance with an embodiment of the present invention. The group driving service authentication system includes a moving object group 110 having a plurality of moving objects 110/1 to **110/*n*, a group driving service system 120, and an authentication center 130**.

Referring to FIG. 1, each of the moving objects 110/1 to **110/*n* in the moving object group 110 may be a moving object, which goes on roads or a driving infrastructure, such as a vehicle or a two-wheeled bike. Such a moving object includes a communication equipment capable of performing wireless communications with the group driving service system 120** to implement the present invention, wherein the communication equipment includes a portable communication equipment of a driver, a communication equipment in the moving object, and so on. Herein, the portable communication equipment of the driver may include a mobile phone, a smart phone, a smart pad, a note pad, a tablet PC, and so on. The communication equipment in the moving object may include a navigation equipment.

Therefore, the driver or user of the moving object can receive services of requesting the authentication for the registration of a group driving service of the moving object by accessing the group driving service system 120 through the manipulation of the communication equipment or requesting the registration of the group driving service by transmitting group driving registration information to the group driving service system 120.

Figures 4, 5:
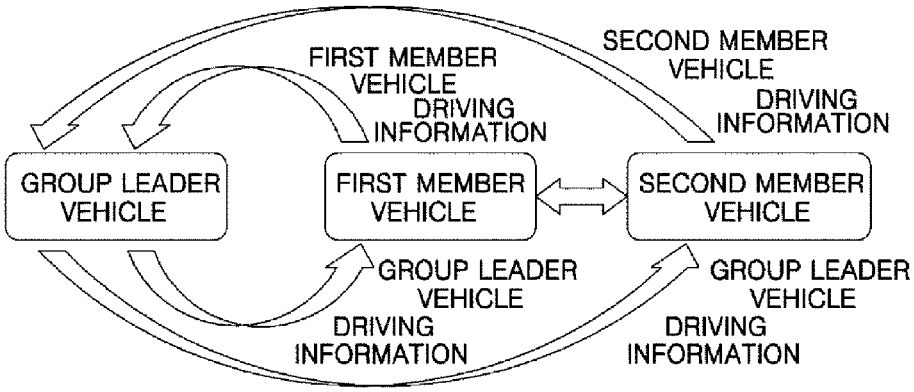
FIG. 4 illustrates group driving registration information in accordance with an embodiment of the present invention.
FIG. 5 is a diagram showing communications between vehicles in a group, which is performed through a group driving service in accordance with an embodiment of the present invention.

Herein, the group driving registration information, which is transmitted from the moving object to the group driving service system 120 through the manipulation of the user or driver for the registration of the group driving service, may include at least one of group driving qualification, a starting place, a destination, an estimated time of departure, an estimated time of arrival, and a desired resting place, as shown in FIG. 4. The group driving qualification may represent an item of selecting a leader or a member.

The group driving service system 120 represents a group driving service authentication device in accordance with the present invention, which provides each moving object with an authentication service for the group driving service. The group driving service system 120 may have a configuration shown in FIG. 2 to provide the authentication service for the group driving service to each moving object in response to a request from each moving object such as an authentication request, a service registration request, and so on.

Figure 2:
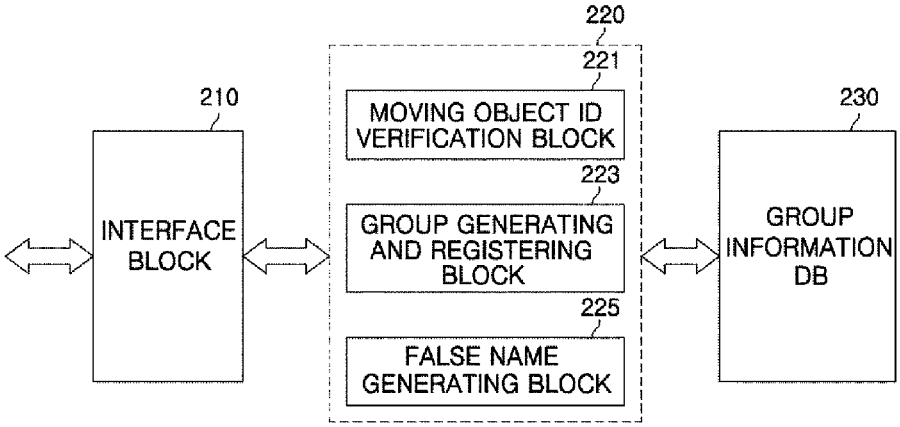
FIG. 2 illustrates a block diagram of a group driving service authentication device of a moving object in accordance with an embodiment of the present invention.

FIG. 2 illustrates a block diagram of a group driving service authentication device in accordance with an embodiment of the present invention, which includes an interface block 210, a driving service managing module 220, and a group information database (DB) 230. The driving service managing module 220 includes a moving object ID verification block 221, a group generating and registering block 223, and a false name generating block 225.

Referring to FIG. 2, the interface block 210 transfers an authentication request, i.e., an authentication request message, to the moving object ID verification block 221 when it receives the authentication request message for the registration of a group driving service from a certain moving object, e.g., 110/1. The interface block 210 transfers a registration request for the group driving service, i.e., a registration request message, which includes group driving registration information, to the group generating and registering block 223 when it receives the registration request message from the moving object 110/1. In addition, the interface block 210 transfers a request message for generating a false name certificate to the authentication center 130 shown in FIG. 1 when it receives the request message for generating the false name certificate from the false name generating block 225. The interface block 210 transfers group driving service registration information to the moving object 110/1 when it receives the group driving service registration information from the group generating and registering block 223.

Herein, the group driving service registration information, which is wirelessly transmitted to the moving object 110/1 through the interface block 210, may include a group ID, a false name assigned to each moving object, and a false name certificate for the false name, and so on.

When an authentication request for the registration of the group driving service, i.e., a moving object authentication request, is received thereto from the moving object 110/1, the moving object ID verification block 221 authenticates an ID of the moving object 110/1. The authentication of the moving object ID may be performed using a digital signature algorithm of a public key crypto system. That is, the moving object 110/1 transmits a message signed with its private key to the group driving service system 120 to request the ID authentication.

Moreover, when the moving object 110/1 is authenticated to be valid as a result of the verification, the moving object ID verification block 221 generates an authentication response corresponding thereto and transmits the authentication response to the moving object 110/1 through the interface block 210. That is, the moving object ID verification block 221 can verify the message signed with the private key of the moving object 110/1 using a public key of the moving object 110/1.

When the authentication response is received thereto, i.e., the authentication for the moving object 110/1 is achieved, the moving object 110/1 transmits the group driving registration information to the group driving service system 120 to request the registration of the group driving service. The group driving registration information may include at least one of group driving qualification, a starting place, a destination, an estimated time of departure, an estimated time of arrival, and a desired resting place, as shown in FIG. 4.

When the registration request for the group driving service, which includes the group driving registration information, is received thereto from the moving object 110/1 through the interface block 210, the group generating and registering block 223 generates a certain group having the group driving service registration information using the group driving registration information, e.g., the same destination, the same starting place, the same estimated time of arrival, and so on, and stores or registers information on the certain group in the group information DB 230. Herein, the certain group may include at least one group leader, i.e., a leader moving object, and at least one member, i.e., a member moving object.

The false name generating block 225 generates a false name assigned to each of moving objects including the leader moving object and the member moving object in the certain group, generates a certificate request message for requesting the generation of a false name certificate for the false name, transmits the certificate request message to the authentication center 130 through the interface block 210, and acquires the false name certificate that is provided by the authentication center 130 in response to the certificate request message. The false name certificate may include a digitally signed message of the authentication center 130. It is possible to guarantee the justification of the false name through the false name certificate.

The false name is a public key assigned to each moving object by the group driving service system 120. A plurality of false names may be assigned to each moving object. Since the false name does not have information associated with an ID of each moving object, the ID of the moving object participating in the group driving is not exposed, so that it is possible to protect the privacy of each moving object participating the group driving.

The group generating and registering block 223 may generate group driving service registration information for the certain group and transmits the same to each moving object in the certain group through the interface block 210. Herein, the group driving service registration information may include a group ID, a false name assigned to each moving object, a false name certificate for the false name, and so on, and be stored in the group information DB 230.

Each moving object receiving the group driving service registration information performs communications between moving objects using the group driving service registration information to thereby accomplish the group driving. This will be described later with reference to FIGS. 5 and 6.

Figure 3:
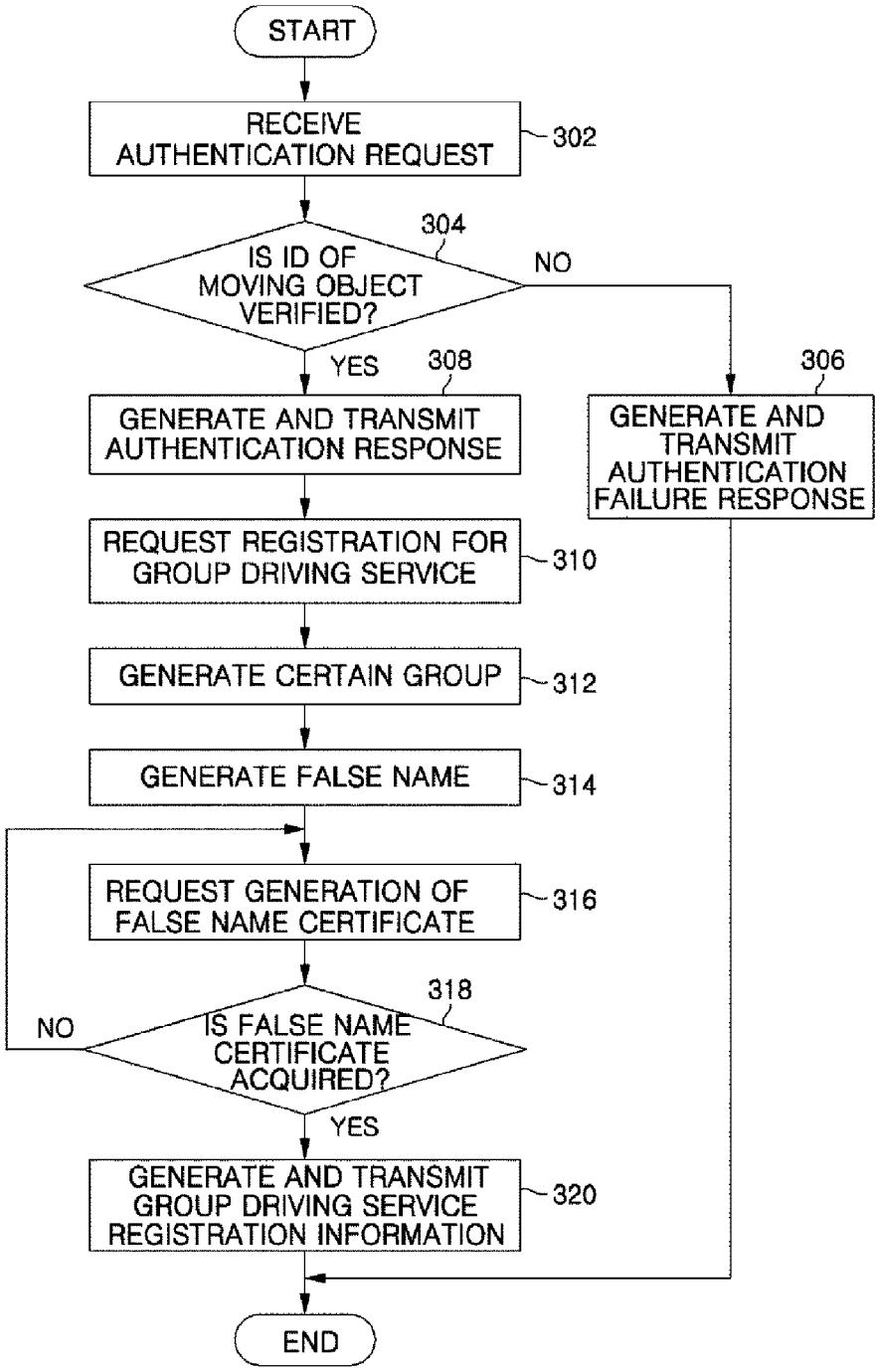
FIG. 3 is a flowchart illustrating processes of providing group driving authentication to a moving object in accordance with an embodiment of the present invention.

FIG. 3 is a flowchart illustrating processes of providing group driving authentication to a moving object in accordance with an embodiment of the present invention.

Referring to FIG. 3, if an authentication request for the registration of a group driving service, i.e., a moving object authentication request, is received from a moving object in a service execution mode in step 302, the moving object ID verification block 221 verifies an ID of the moving object using, e.g., a digital signature algorithm of a public key crypto system, in step 304.

Herein, the authentication request of the moving object may be performed in a manner of transmitting a message signed with a private key of the moving object to the group driving service system 120.

As a result of the verification in step 304, if the ID of the moving object is determined to be invalid, the moving object ID verification block 221 generates an authentication failure response corresponding thereto and transmits the same to the moving object through the interface block 210 in step 306.

As the result of the verification in step 304, if the ID of the moving object is determined to be valid, the moving object ID verification block 221 generates an authentication response for the moving object and transmits the same to the moving object through the interface block 210 in step 308.

Thereafter, when the authentication response is received, i.e., the authentication of the moving object is achieved, after a user inputs and selects group driving registration information including group driving qualification, a starting place, a destination, an estimated time of departure, an estimated time of arrival, and a desired resting place, the moving object, e.g., 110/1, transmits the group driving registration information to the group driving service system 120 to thereby request the registration of the group driving service in step 310.

Subsequently, if a request for the registration of the group driving service, which includes the group driving registration information, is input from the moving object 110/1, the group generating and registering block 223 generates a certain group using the group driving registration information such as the same destination, the same starting place, the same estimated time of arrival, and so on, and then stores/registers information on the certain group in the group information DB 230 in step 312. Herein, the certain group may include at least one group leader, i.e., a leader moving object, and at least one member, i.e., a member moving object.

After that, the false name generating block 225 assigns a false name to each moving object in the certain group in step 314, generates a certificate request message for requesting the generation of a false name certificate for the false name assigned to each moving object in the certain group, and transmits the certificate request message to the authentication center 130 through the interface block 210 in step 316.

The false name generating block 225 monitors whether or not the false name certificate is acquired from the authentication center 130 in step 318. As a result of the monitoring, if the false name certificate is secured, the false name generating block 225 stores the false name certificate in the group information DB 230 and then notifies the group generating and registering block 223 of it. The false name certificate may be a digitally signed message of the authentication center 130. It is possible to guarantee the justification of the false name through the false name certificate. The false name is a public key assigned to each moving object by the group driving service system 120. A plurality of false names may be assigned to each moving object. Since the false name does not have information associated with an ID of each moving object, the ID of the moving object participating in the group driving is not exposed, so that it is possible to protect the privacy of each moving object participating in the group driving.

If the notification is received thereto, the group generating and registering block 223 generates group driving service registration information for the certain group, stores the same in the group information DB 230, and transmits the same to each moving object in the certain group through the interface block 210 in step 320. Herein, the group driving service registration information may include a group ID, a false name assigned to each moving object, a false name certificate for the false name, and so on.

Each moving object, i.e., a user of the moving object, in the certain group for which the group driving service is registered can accomplish the group driving by performing communications between moving objects in the certain group using the group driving service registration information provided from the group driving service system 120.

Herein, a communication message for the communications between moving objects in the certain group may include at least one of a false name, a false name certificate, an expiration date, a group ID, moving object navigation data, and a moving object navigation data signature, as illustrated in FIG. 6. The expiration date means an expiration date of the false name. The moving object navigation data may represent speed information and location information of each moving object in the certain group. The communication message may further include driver input information provided by a driver of each moving object even though it is not illustrated in FIG. 6.

For instance, as shown in FIG. 5, provided that the moving object is a vehicle and there is a group including a group leader vehicle, a first member vehicle, and a second member vehicle, the group leader vehicle generates a communication message including its driving information such as speed information, location information, and so on, and transmits the communication message to the first and second member vehicles. Each of the first and second member vehicles generates a communication message including its driving information such as speed information, location information, and so on, and transmits the communication message to the group leader vehicle. As a result, the communications between the vehicles are performed, and thus a group driving service of the certain group can be accomplished.

Meanwhile, the combinations of each block of the accompanying block diagram and each step of the accompanying flowchart may be performed by computer program instructions. These computer program instructions may be loaded on a processor of a general-purpose computer, a special-purpose computer, or other programmable data processing equipments. Therefore, the instructions performed by the processor of the computers or other programmable data processing equipments generate units for performing functions explained in each step of the flowchart or each block of the block diagram. Since the computer program instructions can be stored in a computer usable memory or a computer readable memory to be employed in a computer or other programmable data processing equipments to implement functions of the instructions in a specific manner, the instructions stored in the computer usable memory or the computer readable memory can be manufactured as products employing an instruction unit for performing functions explained in each step of the flowchart or each block of the block diagram. Since the computer program instructions can be loaded on the computer or other programmable data processing equipments, a sequence of operating steps is performed on the computer or other programmable data processing equipments to generate a process performed by the computer. Therefore, the instructions processed by the computer or other programmable data processing equipments can provide steps of performing the functions explained in each step of the flowchart and each block of the block diagram.

In addition, each block or each step may represent a part of a module, a segment, or a code including at least one executable instruction for performing specific logical function(s). In accordance with other embodiments, it is noted that the functions mentions in the blocks or steps can be performed regardless of their order. For instance, two blocks or steps illustrated sequentially can be simultaneously performed or the blocks or steps can be performed in reverse order according to their functions.

While the invention has been shown and described with respect to the preferred embodiments, the present invention is not limited thereto. It will be understood by those skilled in the art that various changes and modifications may be made without departing from the scope of the invention as defined in the following claims.

What is claimed is:

1. A method for authenticating a group driving service of a moving object, the method comprising:

authenticating, via a processor configured by computer program instructions, the moving object when an authentication request for the registration of the group driving service is received from the moving object, wherein authenticity of the moving object is verified by a moving object identifier, and wherein the moving object is a vehicle;

generating, via the processor configured by the computer program instructions, a certain group having group driving service registration information based on group driving registration information when a registration request for the group driving service is received from the moving object, the registration request including the group driving registration information;

storing, in a memory, the group driving registration information and the group driving service registration information in a group information database, including at least one group leader and one member;

transmitting, via communication equipment capable of performing wireless communications, the group driving service registration information of the certain group to the moving object;

generating a false name of each moving object in the certain group before transmitting the group driving service registration information to the moving object;

requesting, from an authentication center, the generation of a false name certificate for the false name; and receiving the false name certificate from the authentication center.

2. The method of claim 1, wherein the authenticating of the moving object comprises:

receiving the authentication request from the moving object;

verifying an ID of the moving object; and generating an authentication response based on a result of verifying the ID and transmitting the authentication response to the moving object.

3. The method of claim 1, wherein the authenticating of the moving object is performed using a digital signature algorithm of a public key crypto system.

4. The method of claim 1, wherein the group driving registration information comprises one of group driving qualification, a starting place, a destination, an estimated time of departure, an estimated time of arrival, a desired resting place, and a combination thereof.

5. The method of claim 1, wherein the group driving service registration information comprises a group ID of the certain group and the false name for each moving object in the certain group.

6. The method of claim 1, further comprising performing communications between moving objects in the certain group using the group driving service registration information.

7. The method of claim 6, wherein a communication message for the communications between the moving objects comprises one of a false name, a false name certificate, an expiration date, a group ID, moving object navigation data, a moving object navigation data signature, and a combination thereof.

8. The method of claim 7, wherein the expiration date is an expiration date of the false name.

9. The method of claim 7, wherein the moving object navigation data comprises speed information and location information of each moving object in the certain group.

10. The method of claim 7, wherein the communication message further comprises driver input information provided by a driver of each moving object in the certain group.

11. An apparatus for authenticating a group driving service of a moving object, the apparatus comprising:

a processor, configured by computer program instructions, to:

authenticate, by a moving object identification (ID) verification block, an ID of the moving object when an authentication request for the registration of the group driving service is received from the moving object, wherein authenticity of the moving object is verified by a moving object identifier;

generate, by a group generating and registering block, a certain group having group driving service registration information based on group driving registration information when a registration request for the group driving service is received from the moving object, the registration request including the group driving registration information;

secure, by a false name generating block, a false name certificate including a false name assigned to each moving object in the certain group;

store, in a group information database, the group driving registration information and the group driving service registration information, including at least one group leader and one member; and transmit, by an interface block, the group driving service registration information including the false name certificate to the moving object.

12. The apparatus of claim 11, wherein the moving object ID verification block is configured to verify the ID using a digital signature algorithm of a public key crypto system.

13. The apparatus of claim 11, wherein the group driving registration information comprises one of group driving qualification, a starting place, a destination, an estimated time of departure, an estimated time of arrival, a desired resting place, and a combination thereof.

14. The apparatus of claim 11, wherein the false name generating block is configured to generate a false name of each moving object in the certain group, request an authentication center the generation of a false name certificate for the generated false name through the interface block, and secure the false name certificate from the authentication center.

15. The apparatus of claim 14, wherein the group driving service registration information comprises a group ID and the false name of each moving object.

* * * * *